US012161949B2

(12) United States Patent
Lin

(10) Patent No.: US 12,161,949 B2
(45) Date of Patent: Dec. 10, 2024

(54) BUBBLE MACHINE WITH ADJUSTABLE BLOWING ANGLE

(71) Applicant: Lizhen Lin, New Taipei (CN)

(72) Inventor: Lizhen Lin, New Taipei (CN)

( * ) Notice: Subject to any disclaimer, the term of this patent is extended or adjusted under 35 U.S.C. 154(b) by 209 days.

(21) Appl. No.: 17/881,620

(22) Filed: Aug. 5, 2022

(65) Prior Publication Data

US 2022/0370929 A1 Nov. 24, 2022

(51) Int. Cl.
*A63H 33/28* (2006.01)

(52) U.S. Cl.
CPC ..... *A63H 33/28* (2013.01)

(58) Field of Classification Search
CPC ..... A63H 33/28; A61L 9/032
USPC ..... 415/126–128; 416/246
See application file for complete search history.

(56) References Cited

U.S. PATENT DOCUMENTS

RE39,443 E * 12/2006 Schramm ..... B65D 23/00 141/311 A
7,156,616 B2 * 1/2007 Lee ..... F04D 25/166 415/214.1
8,197,193 B2 * 6/2012 Messmer ..... F04D 29/4226 415/126
9,513,028 B2 * 12/2016 Gammack ..... F04D 29/403
10,363,492 B1 * 7/2019 Thai ..... A63H 33/28
10,780,366 B1 * 9/2020 Yang ..... A63H 33/28
11,384,956 B2 * 7/2022 Brown ..... A61L 9/125
11,458,411 B1 * 10/2022 Thai ..... A63H 33/26
11,826,670 B1 * 11/2023 Thai ..... A63H 11/10
2006/0052028 A1 * 3/2006 Thai ..... A63H 33/28 446/16
2008/0274662 A1 * 11/2008 Lo ..... A63H 33/28 446/16
2009/0163109 A1 * 6/2009 Thai ..... A63H 33/28 446/16
2009/0209163 A1 * 8/2009 Thai ..... A63H 33/28 446/15
2012/0220184 A1 * 8/2012 Orem ..... A63H 33/28 446/16

(Continued)

*Primary Examiner* — Eugene L Kim
*Assistant Examiner* — Matthew B Stanczak
(74) *Attorney, Agent, or Firm* — Jose Cherson Weissbrot

(57) ABSTRACT

A bubble machine with an adjustable blowing angle comprises a machine body, an air supply mechanism arranged inside the machine body, and a film forming mechanism, wherein the air supply mechanism comprises a double-shaft motor, a fan cover arranged outside the double-shaft motor, and the film forming mechanism comprises a rotary table, a plurality of bubble rings uniformly arranged on the circumference of the rotary table, and a liquid storage tank arranged below the rotary table; one output shaft of the double-shaft motor is provided with a fan blade, and the other output shaft of the double-shaft motor drives the rotary table to rotate after being decelerated by a gear box; the bubble rings are arranged along the normal of the rotary table, and the fan cover is provided with a rotatable air duct at the position of the air outlet; the bubble rings are arranged along the normal of the rotary table, and then the air flow is output to the bubble rings through the action of the air duct. The air flow is strong, the wind force is sufficient, the bubbling effect is good, and the angle of the air duct is adjustable, which is suitable for more practical scenes.

8 Claims, 5 Drawing Sheets

(56) References Cited

U.S. PATENT DOCUMENTS

| | | | | |
|---|---|---|---|---|
| 2015/0133021 | A1* | 5/2015 | Huey | A63H 33/28 446/15 |
| 2015/0265940 | A1* | 9/2015 | Chan | A63H 33/28 446/16 |
| 2017/0350416 | A1* | 12/2017 | Peters | F04D 29/462 |
| 2018/0335228 | A1* | 11/2018 | Brown | F24F 8/10 |
| 2019/0126161 | A1* | 5/2019 | Yang | A63J 5/02 |
| 2020/0061487 | A1* | 2/2020 | Thai | A63H 33/28 |
| 2020/0139262 | A1* | 5/2020 | Yang | A63H 33/28 |
| 2020/0155957 | A1* | 5/2020 | Clayton | A63H 29/22 |
| 2020/0398177 | A1* | 12/2020 | Peeples | A63H 33/28 |
| 2021/0129040 | A1* | 5/2021 | Chan | A63H 33/28 |
| 2021/0260496 | A1* | 8/2021 | Yang | A63H 33/28 |
| 2022/0316752 | A1* | 10/2022 | Brown | F24F 7/007 |
| 2022/0370929 | A1* | 11/2022 | Lin | A63H 33/28 |
| 2023/0001320 | A1* | 1/2023 | Yang | A63H 29/22 |
| 2023/0055009 | A1* | 2/2023 | Lo | A63H 33/28 |
| 2023/0135754 | A1* | 5/2023 | Yang | A63H 33/28 446/15 |
| 2023/0158419 | A1* | 5/2023 | Ruggiero | A63H 33/28 446/15 |
| 2023/0241527 | A1* | 8/2023 | Petrarca | A63H 33/28 446/16 |
| 2023/0264113 | A1* | 8/2023 | Mei | A63H 33/28 446/16 |
| 2023/0285871 | A1* | 9/2023 | Chan | A63H 33/28 |

* cited by examiner

BUBBLE MACHINE WITH ADJUSTABLE BLOWING ANGLE

TECHNICAL FIELD

The present application relates to a bubble machine with an adjustable blowing angle.

BACKGROUND

Bubbles are formed by the surface tension of water. A foaming solution with certain viscosity, ductility and surface tension and a closed bubble ring are required to produce bubbles. When the foaming solution flows through the bubble ring, the foaming solution hangs on the surface of the bubble ring to form a liquid film. When the liquid film leaves the bubble ring under the action of air flow, it will seal a certain amount of air, thus producing bubbles.

A bubble machine is a device that can automatically generate bubbles. The bubble machine can be used to continuously deliver bubbles to the environment, which plays a role in setting off atmosphere and entertainment. It is a popular daily toy. The existing bubble machine usually comprises a machine body. An air supply mechanism and a film forming mechanism are arranged in the machine body along the generating path of the bubbles. The air supply mechanism comprises a fan blade and a driving motor driving the fan blade to rotate, and the film forming mechanism comprises a liquid storage tank and bubble rings; the motor drives the fan blade to rotate and generate air flow, and at the same time drives the bubble rings to rotate through the liquid storage tank to obtain a liquid film. The air flow generated by the fan blades is sent to the bubble rings to take the liquid film away from the bubble rings to obtain bubbles. The blowing angle of the existing bubble machine is basically horizontal, which cannot meet the actual diversified requirements.

SUMMARY

In view of the shortcomings of the above problems, the present application provides a bubble machine with an adjustable blowing angle.

In order to achieve the above purpose, the present application provides a bubble machine with an adjustable blowing angle, including a machine body, an air supply mechanism and a film forming mechanism arranged inside the machine body, wherein the air supply mechanism includes a double-shaft motor and a fan cover arranged outside the double-shaft motor, and the film forming mechanism includes a rotary table, a plurality of bubble rings uniformly arranged on the circumference of the rotary table and a liquid storage tank arranged below the rotary table; one output shaft of the double-shaft motor is provided with a fan blade, and the other output shaft of the double-shaft motor drives the rotary table to rotate after being decelerated by a gear box; the bubble rings are arranged along a normal direction of the rotary table, and the fan cover is provided with a rotatable air duct at the position of an air outlet, the machine body includes a base and an upper cover which are detachably connected, and the air duct rotates around the output shaft of the double-shaft motor far away from the fan blade; a guide sleeve is arranged between the air duct and the gear box, and the guide sleeve is used for the output shaft of the double-shaft motor far away from the fan blade to pass through; a rotary cylinder is fixed on the outer side of the air duct, and a peripheral surface of the rotary cylinder is provided with an integrally formed toggle block; the upper cover is provided with an adjusting slideway corresponding to the toggle block, and the machine body is also provided with a detachable liquid replenishing bottle, a mouth of which is downward and communicated with the liquid storage tank; the liquid replenishing bottle includes a bottle body and a screw cap screwed on a bottle mouth of the bottle body; a rubber gasket for sealing is arranged between the bottle body and the screw cap, and the screw cap has a middle hole communicated with an inner cavity of the bottle body, and a valve rod is arranged at the middle hole, an upper end of the valve rod is provided with a blocker, and the outer side of the valve rod is provided with a compression spring.

The bubble rings is arranged along the normal of the rotary table, and then the air flow is output to the bubble ring through the action of the air duct, so that the air flow is strong, the wind force is sufficient, the bubble effect is good, and the angle of the air duct is adjustable, which is suitable for more practical scenes.

As a further improvement of the solution, the angle of the adjusting slideway is ninety degrees.

In the above technical solution, the air outlet can be adjusted in the range of 0-90 degrees by adjusting the angle design of the slideway.

As a further improvement of the solution, the lower part of the base is provided with a battery compartment, and the upper part of the upper cover is provided with a switch, which is electrically connected with the double-shaft motor and has the functions of starting, stopping and speed regulation.

In the above technical solution, the control of the bubble machine is realized by manually operating the switch.

As a further improvement of the solution, a circuit board is arranged on the upper cover, a remote control module is arranged on the circuit board, and the circuit board is provided with an electric plug connected with an external power adapter.

In the above technical solution, the bubble machine can be remotely controlled by the remote controller to realize the functions of starting, stopping and speed regulation, and the bubble machine can be connected to the commercial power through the power adapter, thus reducing the use of batteries.

As a further improvement of the solution, a net cover is arranged between the base and the upper cover, and the net cover is arranged on the air inlet side of the fan blade.

In the above technical solution, the net cover can filter impurities in the air and protect the double-shaft motor.

As a further improvement of the solution, there are four protruding support legs under the base, and the lower surfaces of the support legs are provided with anti-slip pads.

In the above technical solution, the support legs play a supporting role, and the anti-skid pad plays an anti-skid and anti-shock role, thus ensuring the stability of the bubble machine when working.

Compared with the prior art, the present application has the advantages that the bubble ring of the existing bubble machine is arranged along the radial direction of the rotary table, and the airflow needs to pass through the rotary table to reach the bubble rings, so that the airflow is small and the intermediate loss is large; in this solution, the bubble rings are arranged along the normal of the rotary table, and then the air flow is output to the bubble rings through the action of the air duct, so that the air flow is strong, the wind force is sufficient, the bubble effect is good, and the angle of the air duct is adjustable, which is suitable for more actual scenes; it is equipped with a switch with start-stop, speed-regulating functions, a remote controller to realize remote control, which can be plugged in or powered by a battery compartment, and a liquid replenishing bottle to automatically replenish a foaming solution, thus enhancing functionality.

Figure 1:
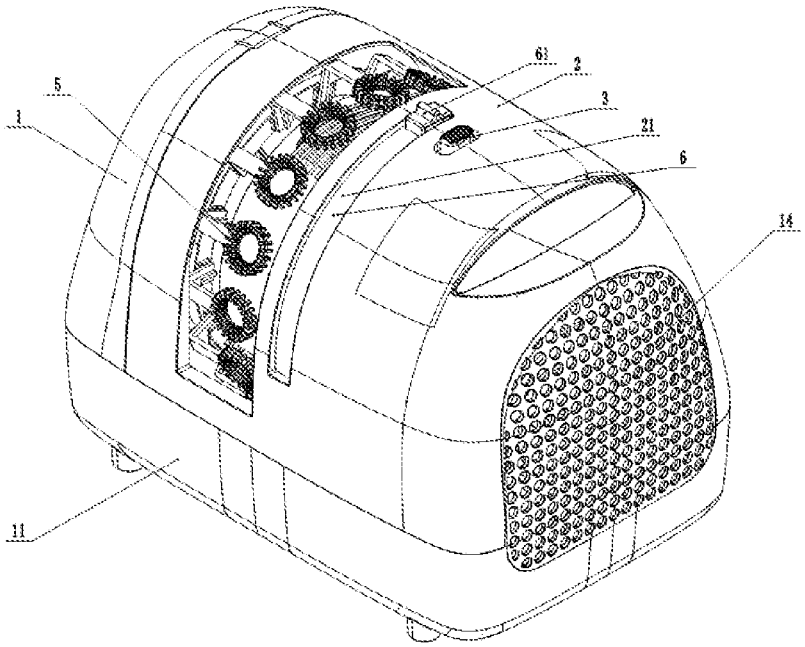
FIG. 1 is a perspective view of a bubble machine with an adjustable blowing angle.

in the figures: 1. Liquid replenishing bottle; 2. Upper cover; 21. Adjusting slideway; 3. Switch; 4. Rotary table; 5. Bubble ring; 6. Rotary cylinder; 61, Toggle block; 7. Air duct; 8. Double-shaft motor; 9. Fan blade; 10. Fan cover; 11. Base; 12. Liquid storage tank; 13. Circuit board; 14. Net cover; 15. Guide sleeve; a1. Bottle body; a2, screw cap; a3, Rubber pad; a4, Compression spring; a5. Blocker; a6, Valve rod.

DESCRIPTION OF EMBODIMENTS

As shown in FIGS. 1-5, a bubble machine with an adjustable blowing angle according to the embodiment of the present application includes a machine body, an air supply mechanism and a film forming mechanism arranged inside the machine body, wherein the air supply mechanism includes a double-shaft motor 8 and a fan cover 10 arranged outside the double-shaft motor 8, and the film forming mechanism comprises a rotary table 4, a plurality of bubble rings 5 uniformly arranged on the circumference of the rotary table 4; one output shaft of the double-shaft motor 8 is provided with a fan blade 9, and the other output shaft of the double-shaft motor 8 drives the rotary table 4 to rotate after being decelerated by a gear box; the bubble rings 5 are arranged along a normal direction of the rotary table 4, and the fan cover 10 is provided with a rotatable air duct 7 at the position of an air outlet, the machine body includes a base 11 and an upper cover 2 which are detachably connected, and the air duct 7 rotates around the output shaft of the double-shaft motor 8 far away from the fan blade 9; a guide sleeve 15 is arranged between the air duct 7 and the gear box, and the guide sleeve 15 is used for the output shaft of the double-shaft motor 8 far away from the fan blade 9 to pass through; a rotary cylinder 6 is fixed on the outer side of the air duct 7, and a peripheral surface of the rotary cylinder 6 is provided with an integrally formed toggle block 61; the upper cover 2 is provided with an adjusting slideway 21 corresponding to the toggle block 61; the air duct and the output shaft of the double-shaft motor away from the fan blade are concentrically arranged, and at the same time a guide sleeve is arranged to avoid air volume loss caused by air leakage. Meanwhile, the guide sleeve plays a supporting role for the output shaft to ensure the output shaft is horizontal; a toggle block is used to realize the rotation of the rotary cylinder while adjusting the sliding, and the rotary cylinder drives the air duct to rotate to realize the angle adjustment of the air outlet; the angle of the slideway 21 is adjusted to 90 degrees, and the air outlet can be adjusted in the range of 0-90 degrees by adjusting the angle design of the slideway; the lower part of the base 11 is provided with a battery compartment, and the upper part of the upper cover 2 is provided with a switch 3, which is electrically connected with a double-shaft motor 8, and the switch 3 has the functions of starting, stopping and regulating speed, so that the control of the bubble machine can be realized by manually operating the switch; the upper cover 2 is provided with a circuit board 13, which is provided with a remote control module, and the circuit board 13 is provided with an electric plug connected with an external power adapter, so that the bubble machine can be remotely controlled by the remote controller to realize the functions of starting, stopping and speed regulation, and the bubble machine can be connected to commercial power through the power adapter, thereby reducing the use of batteries; a net cover 14 is arranged between the base 11 and the upper cover 2, and the net cover 14 is arranged on the air inlet side of the fan blade 9, which can filter air impurities and protect the double-shaft motor; the machine body is also provided with a detachable liquid replenishing bottle 1, and the bottle mouth of the liquid replenishing bottle 1 faces downwards and is communicated with the liquid storage tank 12, so that the foaming solution in the liquid storage tank can be replenished in time through the liquid replenishing bottle, thereby reducing the inconvenience of frequently manually replenishing the foaming solution; the lower part of the base 11 is provided with four raised support legs, and the lower surfaces of the support legs are provided with anti-slip pads, which play a supporting role, and the anti-slip pads play an anti-slip and anti-shock role, thus ensuring the stability of the bubble machine when working; the liquid replenishing bottle 1 includes a bottle body a1 and a screw cap a2 screwed on the bottle opening position of the bottle body a1, a rubber pad a3 for sealing is arranged between the bottle body a1 and the screw cap a2, the screw cap a2 has a middle hole communicated with the inner cavity of the bottle body a1, a valve rod a6 is arranged at the middle hole, a blocker a5 is arranged at the upper end of the valve rod a6, and a compression spring a4 is arranged at the outer side of the valve rod a6. When the liquid replenishing bottle is not in use, the force of the compression spring forces the blocker to block the middle hole of the screw cap to avoid liquid leakage. When the liquid replenishing bottle is inserted on the base of the machine body, the base forces the valve rod upward to overcome the elasticity of the compression spring, so that the plug is separated from the screw cap, and the foaming solution of the liquid replenishing bottle can flow out from the gap between the plug and the screw cap to the liquid storage tank for automatic replenishment.

The bubble rings of the existing bubble machine are arranged along the radial direction of the rotary table, and the air flow needs to pass through the rotary table to reach the bubble rings, so the air flow rate is small and the intermediate loss is large; in this solution, the bubble rings are arranged along the normal of the rotary table, and then the air flow is output to the bubble rings by means of the action of the air duct, so that the air flow is strong, the wind force is sufficient, the bubble effect is good, and the angle of the air duct is adjustable, which is suitable for more actual scenes; it is equipped with a switch with start-stop, speed-regulating functions, a remote controller to realize remote control, which can be plugged in or powered by a battery compartment, and a liquid replenishing bottle to automatically replenish foaming solution, thus enhancing functionality.

When in use, in order to facilitate the understanding of the present application, described shall be made with reference to the drawings.

Figure 2:
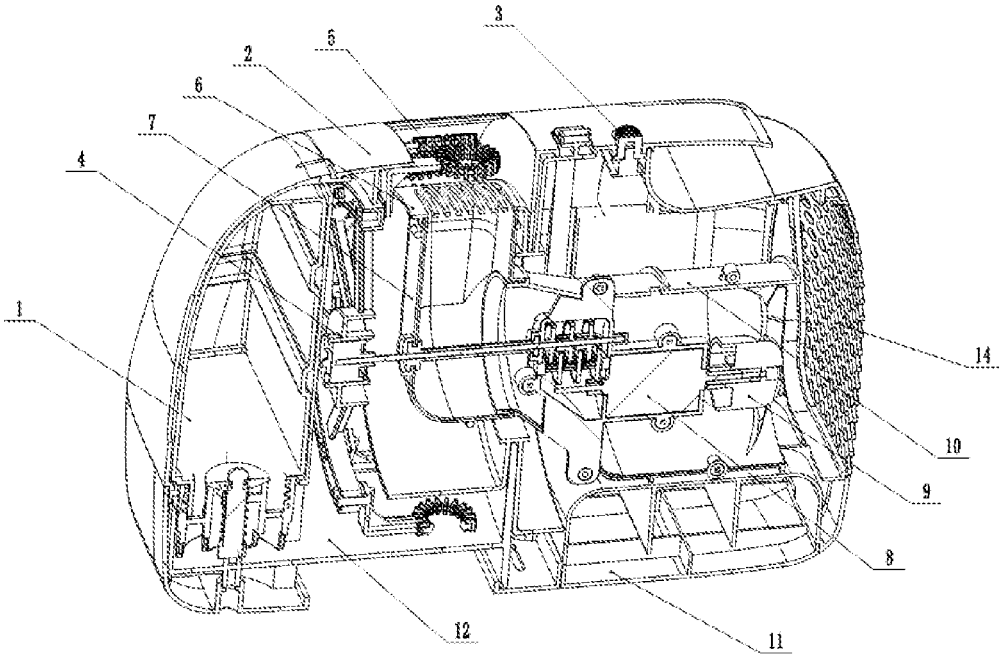
FIG. 2 is a sectional view of a bubble machine with an adjustable blowing angle according to the present application.
Figure 3:
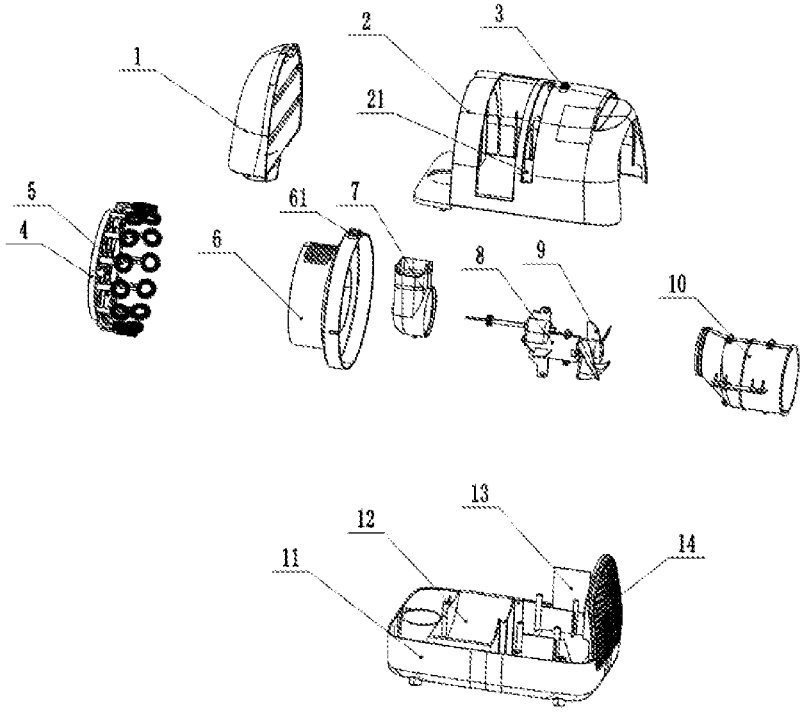
FIG. 3 is an explosion diagram of a bubble machine with an adjustable blowing angle.
Figure 4:
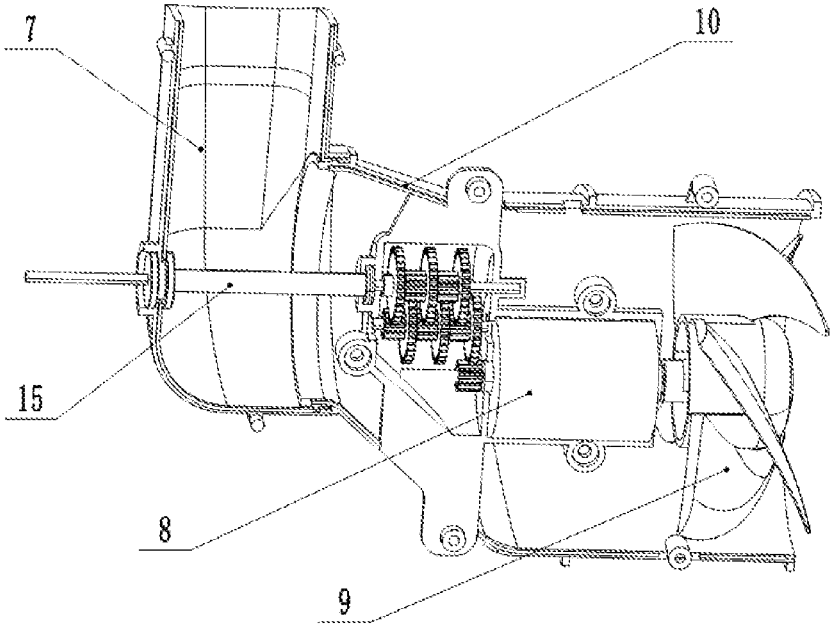
FIG. 4 is a schematic diagram of the guide sleeve installed between the air duct and the gear box.
Figure 5:
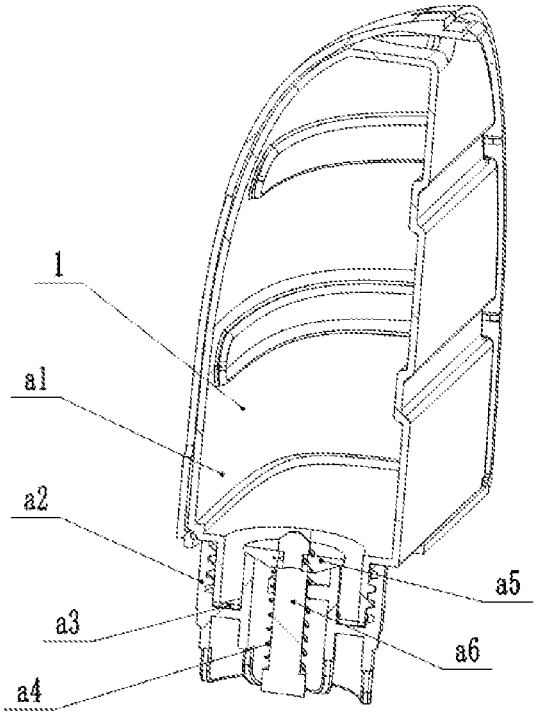
FIG. 5 is a cross-sectional view of the liquid replenishing bottle.

As shown in FIG. 2, when the double-shaft motor 8 works, air enters the fan cover 10 through the net cover 14, and is output after passing through the air duct 7 and the rotary cylinder 6. The rotary table 4 is driven by the double-shaft motor 8, and a plurality of bubble rings 5 sequentially pass through the air outlet of the rotary cylinder 6 to continuously output bubbles. When it is necessary to adjust the blowing angle, it is only necessary to adjust the position of the toggle block 61 on the adjusting slideway 21, and the rotary cylinder 6 and the air duct 7 rotate synchronously to change the position of the air outlet.

The above is only the preferred embodiment of the present application, and it is not intended to limit the present application. For those skilled in the art, the present application can be modified and varied. Any modification, equivalent substitution, improvement, etc. made within the spirit and principle of the present application shall be included in the scope of protection of the present application.

What is claimed is:

1. A bubble machine with an adjustable blowing angle, comprising a machine body, an air supply mechanism and a film forming mechanism arranged inside the machine body, wherein the air supply mechanism comprises a double-shaft motor and a fan cover arranged outside the double-shaft motor, and the film forming mechanism comprises a rotary table, a plurality of bubble rings uniformly arranged on the circumference of the rotary table and a liquid storage tank arranged below the rotary table; one output shaft of the double-shaft motor is provided with a fan blade, and the other output shaft of the double-shaft motor drives the rotary table to rotate after being decelerated by a gear box; the bubble rings are arranged along a normal direction of the rotary table, and the fan cover is provided with a rotatable air duct at the position of an air outlet, the machine body comprises a base and an upper cover which are detachably connected, and the air duct rotates around the output shaft of the double-shaft motor at a location away from the fan blade; a guide sleeve is arranged between the air duct and the gear box, and the guide sleeve is used for the output shaft of the double-shaft motor at the location away from the fan blade to pass through; a rotary cylinder is fixed on the outer side of the air duct, and a peripheral surface of the rotary cylinder is provided with an integrally formed toggle block; the upper cover is provided with an adjusting slideway corresponding to the toggle block, and the machine body is also provided with a detachable liquid replenishing bottle, a mouth of which is downward and communicated with the liquid storage tank; the liquid replenishing bottle comprises a bottle body and a screw cap screwed on a bottle mouth of the bottle body; a rubber gasket for sealing is arranged between the bottle body and the screw cap, and the screw cap has a middle hole communicated with an inner cavity of the bottle body, and a valve rod is arranged at the middle hole, an upper end of the valve rod is provided with a blocker, and the outer side of the valve rod is provided with a compression spring.

2. The bubble machine with an adjustable blowing angle according to claim 1, wherein the angle of the adjusting slideway is ninety degrees.

3. The bubble machine with an adjustable blowing angle according to claim 1, wherein a lower part of the base is provided with a battery compartment, and an upper part of the upper cover is provided with a switch, which is electrically connected with the double-shaft motor and has the functions of starting, stopping and speed regulating.

4. The bubble machine with an adjustable blowing angle according to claim 3, wherein the upper cover is provided with a circuit board, the circuit board is provided with a remote control module, and the circuit board is provided with an electric plug connected with an external power adapter.

5. The bubble machine with an adjustable blowing angle according to claim 4, wherein a net cover is arranged between the base and the upper cover, and the net cover is arranged on an air inlet side of the fan blade.

6. The bubble machine with an adjustable blowing angle according to claim 5, wherein there are four protruding support legs under the base, and the lower surfaces of the support legs are provided with anti-slip pads.

7. A bubble machine with an adjustable blowing angle, comprising a machine body, an air supply mechanism and a film forming mechanism arranged inside the machine body, wherein the air supply mechanism comprises a double-shaft motor and a fan cover arranged outside the double-shaft motor, and the film forming mechanism comprises a rotary table, a plurality of bubble rings uniformly arranged on the circumference of the rotary table; one output shaft of the double-shaft motor is provided with a fan blade, and the other output shaft of the double-shaft motor drives the rotary table to rotate after being decelerated by a gear box; the bubble rings are arranged along a normal direction of the rotary table, and the fan cover is provided with a rotatable air duct at the position of an air outlet, the machine body comprises a base and an upper cover which are detachably connected, and the air duct rotates around the output shaft of the double-shaft motor at a location away from the fan blade; a guide sleeve is arranged between the air duct and the gear box, and the guide sleeve is used for the output shaft of the double-shaft motor at the location away from the fan blade to pass through; a rotary cylinder is fixed on the outer side of the air duct, and a peripheral surface of the rotary cylinder is provided with an integrally formed toggle block; the upper cover is provided with an adjusting slideway corresponding to the toggle block, and the machine body is also provided with a detachable liquid replenishing bottle, a mouth of which is downward and communicated with the liquid storage tank.

8. A bubble machine with an adjustable blowing angle, comprising a machine body, an air supply mechanism and a film forming mechanism arranged inside the machine body, wherein the air supply mechanism comprises a double-shaft motor and a fan cover arranged outside the double-shaft motor, and the film forming mechanism comprises a rotary table, a plurality of bubble rings uniformly arranged on the circumference of the rotary table; one output shaft of the double-shaft motor is provided with a fan blade, and the other output shaft of the double-shaft motor drives the rotary table to rotate after being decelerated by a gear box; the bubble rings are arranged along a normal direction of the rotary table, and the fan cover is provided with a rotatable air duct at the position of an air outlet, the machine body comprises a base and an upper cover which are detachably connected, and the air duct rotates around the output shaft of the double-shaft motor at a location away from the fan blade; a guide sleeve is arranged between the air duct and the gear box, and the guide sleeve is used for the output shaft of the double-shaft motor at the location away from the fan blade to pass through; a rotary cylinder is fixed on the outer side of the air duct, and a peripheral surface of the rotary cylinder is provided with an integrally formed toggle block; the upper cover is provided with an adjusting slideway corresponding to the toggle block.

* * * * *